United States Patent [19]

Carlson

[11] Patent Number: 4,473,036

[45] Date of Patent: Sep. 25, 1984

[54] MEANS AND METHOD FOR VAPOR GENERATION

[75] Inventor: Larry W. Carlson, Oswego, Ill.

[73] Assignee: The United States of America as represented by the United States Department of Energy, Washington, D.C.

[21] Appl. No.: 453,980

[22] Filed: Dec. 28, 1982

[51] Int. Cl.[3] ..... F22G 5/00

[52] U.S. Cl. ..... 122/479 A; 122/32; 122/479 R; 122/479 S; 165/134 R

[58] Field of Search ..... 122/32, 479 R, 479 A, 122/479 S; 165/134 R

[56] References Cited

U.S. PATENT DOCUMENTS

| | | | |
|---|---|---|---|
| 3,850,148 | 11/1974 | Laubli | 122/479 S |
| 4,031,863 | 6/1977 | Laubli | 122/479 R |
| 4,247,262 | 1/1981 | Lipstein | 165/134 R |
| 4,257,356 | 3/1981 | Minnick | 165/134 R |
| 4,278,069 | 7/1981 | Clark, Jr. | 122/479 R |

*Primary Examiner*—Edward G. Favors
*Assistant Examiner*—Steven E. Warner
*Attorney, Agent, or Firm*—Charles F. Lind; Bruce R. Mansfield; Michael F. Esposito

[57] ABSTRACT

A liquid, in heat transfer contact with a surface heated to a temperature well above the vaporization temperature of the liquid, will undergo a multiphase (liquid-vapor) transformation from 0% vapor to 100% vapor. During this transition, the temperature driving force or heat flux and the coefficients of heat transfer across the fluid-solid interface, and the vapor percentage influence the type of heating of the fluid—starting as "feedwater" heating where no vapors are present, progressing to "nucleate" heating where vaporization begins and some vapors are present, and concluding with "film" heating where only vapors are present. Unstable heating between nucleate and film heating can occur, accompanied by possibly large and rapid temperature shifts in the structures. This invention provides for injecting into the region of potential unstable heating and proximate the heated surface superheated vapors in sufficient quantities operable to rapidly increase the vapor percentage of the multiphase mixture by perhaps 10–30% and thereby effectively shift the multiphase mixture beyond the unstable heating region and up to the stable film heating region.

15 Claims, 5 Drawing Figures

MEANS AND METHOD FOR VAPOR GENERATION

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

Modern vapor generators or evaporators, such as steam generators or boilers, frequently vaporize a media fluid or coolant by passing it in heat transfer contact over a surface heated to a temperature well above the vaporization temperature of the fluid. The fluid to be vaporized (typically water although hydrocarbons or alcohols are commonly used also) at the pressure of the system is a liquid at "bulk" temperatures below the vaporization temperature, is a vapor at bulk temperatures well above the vaporization temperature, and is at multiphase (liquid-vapor) mixtures at bulk temperatures near the vaporization temperature. The surface can be heated electrically; or more commonly by another "heat-in" fluid, such as hot flue gas circulated along a thermally conductive wall on the side opposite from the heated surface and isolated from the vaporizing or "heat-out" fluid (the reference to heat-in and heat-out fluids is thus made in this disclosure relative to bringing heat into or remove heat out of the vapor generator). One such heat exchanger configuration might be of the shell and tube type where the vaporized heat-out fluid (water for example) flows through tubes running through a larger shell, and the heat-in fluid (flue gas for example) flows through the shell and over the tubes. The flow paths for the two media fluids could of course be reversed. Alternatively instead of using hot flue gas as the heat-in fluids, a hot "coolant" (such as water, a liquid metal like sodium, or a gas such as helium) can be circulated through the heat exchanger configuration, the coolant being heated beforehand by any known means immaterial to this invention.

The design chosen for and the effectiveness of heat transfer between the two media fluids would depend on many factors. These would include the differences in the enthalpy "H" and entropy "S" of the respective media at its inlet and outlet to the vapor generator; the temperature driving force and film coefficients of heat transfer across the fluid-solid interface; the pressures, mass and velocity flow rates of each media in the system; and the cost and safety considerations for providing all of the above.

FIG. 1 illustrates a typical pool-boiling curve commonly associated with multiphase fluid of the type to be vaporized; where the log values of "heat flux" inputs are listed as the vertical axis and the log values of "temperature differences" are listed as the horizontal axis. The "heat flux" is related to the temperature driving force of the heated surface, and will vary between less than 1000 Btu/hr. ft.$^2$ for a low output steam generator and perhaps 250,000 Btu/hr. ft.$^2$ for a very high output commercial steam generator. The "temperature difference" is that between the "heated surface" temperature and the bulk temperature of the liquid or of the steam. Since these values are on log scales in FIG. 1, the curve is quite compact insofar as absolute values are concerned.

As identified generally along the curve between A and B, the fluid to be vaporized is in the liquid phase only and no boiling at all takes place on the surface: this is the "feedwater" phase of heating. From B through S and up to C, the local heat flux is sufficient to raise the water temperature adjacent the heated surface to saturation temperature, or slightly above, and a change from the liquid to the vapor state occurs locally. This change is characterized by the coexistence of both phases at essentially the same temperature locally, differing only in a few degrees of vapor superheat necessary for heat transfer and by heat absorption required to overcome the molecular binding forces of the liquid phase. Here, the change of state is accompanied by ebullition of the vapor at the solid-liquid interface (as opposed to evaporation at a free surface); this is the "nucleate boiling" phase of heating.

The bulk of the liquid does not reach saturation temperature until the heat flux of point S is reached. Between B and S, the vapor bubbles formed at the heated surface condense quickly in the liquid giving up latent heat to raise the temperature of the liquid. This condition is known as subcooled-nucleate or local boiling. Nucleate boiling occurs at all points up to C; beyond S, the bubbles do not collapse, since this part of the curve represents boiling with the liquid bulk temperature at saturation.

Both nucleate-boiling regimes (subcooled and saturated), are characterized by very high heat transfer coefficients. These are ascribed to the high secondary velocities of the liquid caused by the liberation of surface tension energies available in the liquid-vapor-solid interfaces at the instant of bubble release from the heated surface. Thus a convection-type transfer coefficient based on bubble kinetics is also affected to some extent by bulk mass velocity, depending on the velocity range.

Beyond the nucleate boiling region (B-C in FIG. 1), the bubbles of vapor forming on the heated surface begin to interfere with the flow of liquid to the surface and eventually coalesce to form a film of superheated vapor over part or all of the heated surface. This condition is known as "film boiling". From D to E film boiling is unstable; beyond point E film boiling becomes stable.

In heat exchangers where the heat flux exceeds that corresponding to point D, the temperature of the heated surface can rise very quickly, along the horizontal dotted line in the figure to point D'. If the temperature at D' is sufficiently high, the heated surface can burn out or melt. Hence, D is known as the burnout point. C is known as the point of departure from nucleate boiling (DNB), or the critical heat flux.

Stable and even unstable film boiling is regularly encountered in certain types of heat transfer equipment where the temperature of the heat source is within the safe operating range of the equipment, or where the boiling film heat transfer coefficient is the controlling resistance to heat flux. Steam generators for pressurized-water nuclear reactor systems, which are actually water-to-boiling water heat exchangers, and certain types of process heat exchange equipment are in this category.

Depending on the "heat flux", nucleate boiling can start with as low as 0–10% vapor in the combined liquid-vapor mixture and continue then into the higher quality multiphase conditions of the fluid, commonly up to no more than 10–50% vapor for commercial boilers, but even up to almost 100% vapor for very low heat fluxes. However, at very high heat fluxes, and at higher quality vapor (10–50%) and moderately high heat fluxes, so many bubbles are being formed that they in effect blanket the remaining liquid from contacting the heated surface. Under such circumstances, the temperature difference (between the heated surface and the bulk or surface temperature of the fluid) can rapidly increase from D to D′, or from D to anywhere on the film boiling curve between E and D′.

The departure from nucleate boiling (DNB) can be an unstable transition condition, since once DNB occurs for any given heat flux, the heat flux that can be used effectively to vaporize the fluid drops off dramatically and any higher heat flux just creates the large "temperature differences" along a curve between D and the film boiling curve between E and D′.

The pool-boiling curve (illustrated in FIG. 1) is representative only of test conditions without forced fluid flow or other agitation that would increase the effective heat transfer coefficients; and thus it is not followed explicitly in any normal vapor generator or steam boiler. However, virtually all multiphase boiler or evaporator sections have different areas or regions where the heating phenomenon converts between "feedwater," "nucleate," and "film" heating. In reference to a steam generator, the feedwater section primarily has only liquid present and operates in the feedwater and/or nucleate heating phases; the boiler section generally has the multiphase liquid-vapor mixture present and operates in the nucleate and film heating phases, and the superheat section has pure vapor present and operates exclusively in the convective phase of heating.

With reference again to FIG. 1, the temperature differences between the heated surface and the bulk fluid at C and D represent perhaps 20°–50° F.; where at D′ the corresponding temperature differences is much larger, perhaps even 500°–1000° F. One basic undesirable characteristic of the "departure from nucleate boiling" (DNB) is that this large temperature shift (up to even 1000° F.) can occur quite rapidly (on the order of only seconds). Thus, serious cyclical thermal stress problems can develop to weaken the feedwater and/or boiler sections of the vapor generator where any DNB might actually occur.

It should be noted further that the heat transfer coefficients in the feedwater or nucleate heating phases are very high (typically 1000–2000 for feedwater heating and 2000–100,000 for nucleate boiling); whereas the heat transfer coefficients in the stable film boiling or conductive heating phase are lower (perhaps 200–1000); and the heat transfer coefficients are the lowest (perhaps 100–500) during the DNB or transition phase of heating. These comparative heating rates can be noted generally by the changing steepness of the curve illustrated in FIG. 1, feedwater heating (A-B) being higher than for the stable film boiling (E, D′, F), while the nucleate boiling (B, S, C, D) is the highest.

It therefore is advantageous to utilize the feedwater heating and/or nucleate boiling regions as much as possible, as contrasted against the film boiling region, so as to minimize the size of the vapor generator.

FIG. 2 illustrates a known complex vapor generator system that eliminates entirely the DNB region, but does so by having two separate boiler or heater sections separated by a liquid-vapor separator or steam drum. The heat-in fluid is shown as passing sequentially through the superheater and the feedwater heater. The vaporizing heat-out fluid in turn passes as a liquid through the feedwater heater, where it is heated to temperatures equal to or near its vaporization temperature, and subsequently enters the liquid-vapor separator as low quality vapor. Vapor from the liquid-vapor separator is then passed through the superheater and is discharged from the system as high pressure superheated vapor. Liquid from the liquid-vapor separator is drawn off and combined with the feedwater for recirculation through the feedwater heater/boiler. The major drawbacks to this complex system are (1) the need for the different components including the liquid-vapor separator, the feedwater heater/boiler, and the superheater; and (2) the recirculation of a great percentage (300–400%) of liquid from the liquid-vapor separator back through the feedwater heater/boiler, increasing the size and both initial and operational costs of the feedwater heater/boiler and the feedwater pumping equipment.

A second known vapor generator system (the Loffler cycle) is illustrated in FIG. 3 and utilizes only a superheater having sufficient volumetric output of vapor that a large percentage of it (approximately 75%) can be bled off, compressed and then be added as superheated vapor to the liquid feedwater before the latter normally would enter into the superheater. This superheated vapor when combined with the feedwater effectively provides at the inlet to the vapor superheater, a mutliphase mixture at sufficiently high quality (95–100% vapor) that it is beyond where DNB might occur. Thus, the DNB problem is eliminated; but this means that all heat addition in the superheater is to vapor only and is by forced convection only. This coupled with the reduced thermal efficiency of heating vapor only necessitates that the single superheater must be substantially larger than the combined feedwater heater/boiler and superheater generators used in the complex system of FIG. 2; while further the large percentage (75%) of fluid recirculation requires that the superheater be even larger. Also, greater pumping costs are incurred (both in pumps and energy) in recirculating the low density superheated vapor back to the superheater.

In general, two factors limit the output of a vapor generator: one being structurally related and the other being heat flux related. With the structurally related limitation, such as an electric resistance heater, lack of coolant flow and the resultant cooling of the heater could allow the heater to exceed the heated surface upper temperature limits so as to destroy itself. The cooling capacity of the vaporizing fluid need of course be sufficient to cool the surface to within the temperature limits. This then brings into play the second type of limiting design, or the heat flux related factor. If the heated surface itself under normal operating outputs cannot be cooled, the heat flux can be too high relative to the coolant used where overheating would occur notwithstanding the existence or loss of coolant. Under such circumstances, again, the increased temperature of the heated surface could possibly destroy the heated surface itself. These factors, however, do not directly bear on the particular invention, but merely serve to emphasize the significant consequence that can occur under DNB transient conditions with the reduced effectiveness of heat transfer and the consequent temperature increase.

SUMMARY OF THE INVENTION

This invention relates to an improved method for and multiphase vapor generator for minimizing unstable departure from nucleate boiling (DNB) and the adverse cyclic thermal strain effects thereof, while yet providing for advantageous compactness in generator size by retaining highly efficient feedwater and nucleate boiling heater sections.

One object of this invention is to provide a multiphase vapor generator or boiler having a high heat flux heated surface over which the fluid to be vaporized flows in heat transfer relation, initially as a liquid near the fluid inlet and ultimately as a vapor near the fluid outlet, and as a multiphase liquid-vapor mixture therebetween, and means and method for eliminating departure from nucleate boiling (DNB) and DNB transients that otherwise would normally occur therein.

A further object of this invention is to provide a multiphase vapor generator and a method and means for injecting into the region of potential DNB and proximate the high heat flux heated surface superheated vapor in sufficient quantities operable to rapidly increase the vapor percentage of the multiphase mixture by perhaps 10–30%, effective thereby to shift beyond the unstable DNB transitions up to the stable forced convection and film boiling heating region.

DETAILED DISCLOSURE OF THE INVENTION

Figure 2:
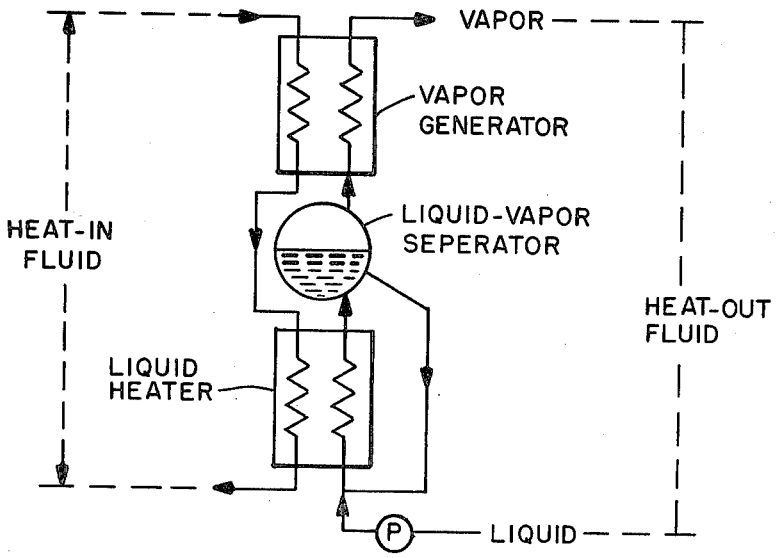
FIG. 2 (PRIOR ART)
FIG. 2 illustrates a conventional multiple component system devised to avoid DNB, having separate liquid heater and vapor generator components and a liquid-vapor separator therebetween and having circuitry for bypassing a generally large ratio of the output liquid from the liquid-vapor separator back to the liquid heater/boiler component.
Figure 3:
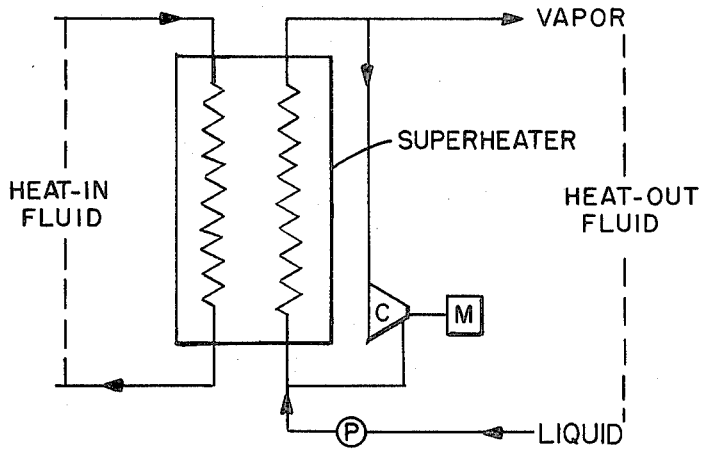
FIG. 3 (PRIOR ART)
FIG. 3 illustrates the conventional Loffler cycle system designed to avoid DNB, having only a superheater or generator section and circuitry for bypassing large volumes or superheated vapor from the generator output and admixing this with the liquid input to the generator for converting the same to high quality vapor for passage then through the superheater vapor generator.
Figure 4:
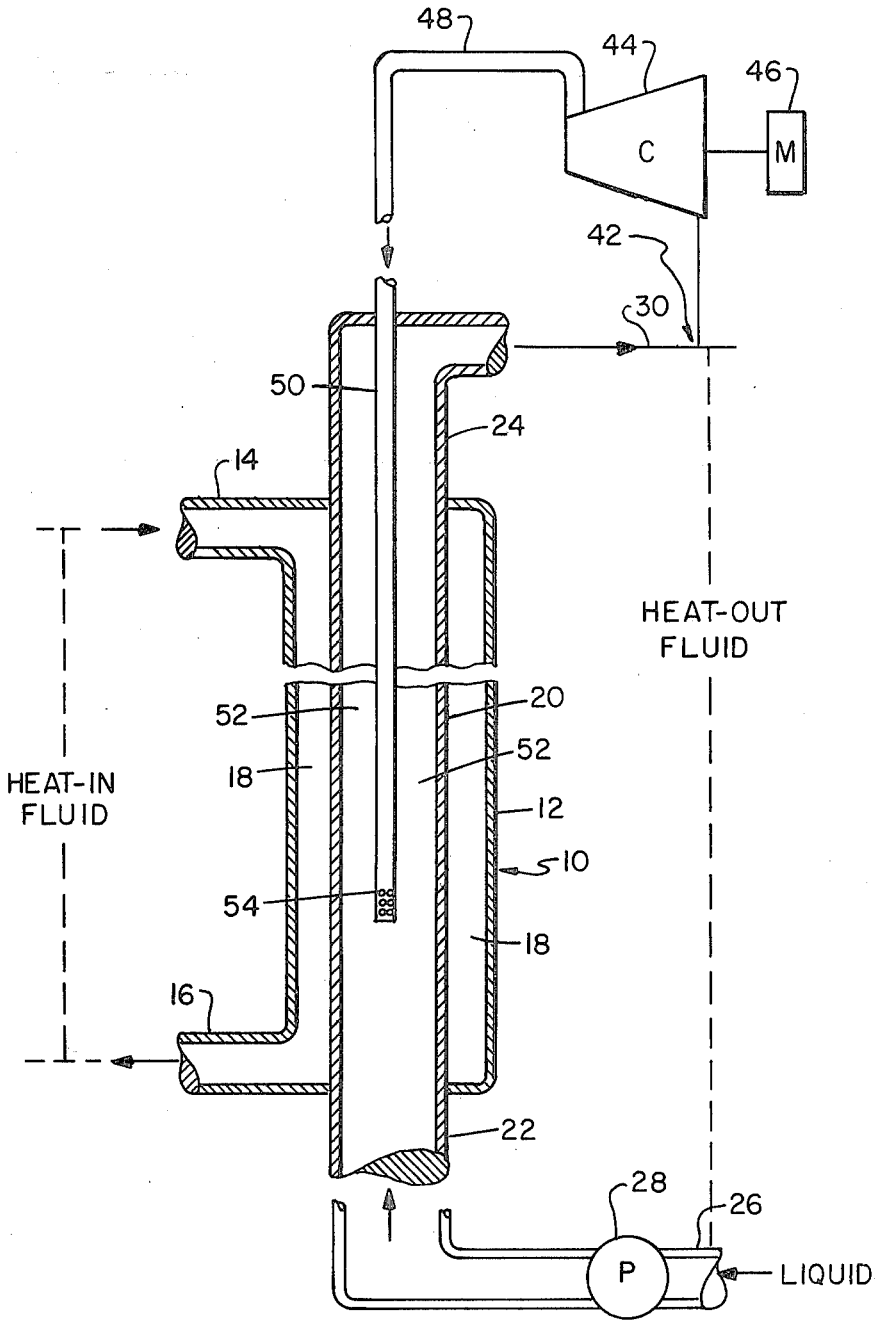
FIG. 4 illustrates in schematic the subject invention, locating specifically a vapor injection means in the boiler section where DNB normally would occur and showing also circuitry for initially bypassing some of the superheated vapor output from the vapor generator, for compressing this bypass, and for discharging it then from the injection means back into the boiler section.

FIG. 4 illustrates the inventive vapor generator or evaporator 10 schematically but yet having more structural details than previously illustrated in the known systems of FIGS. 2 and 3. This evaporator 10 is shown as a shell and tube type heat exchanger having an outer shell 12 and inlet and outlet lines 14 and 16 respectively for a heat-in fluid (such as for flue gas, water or sodium) which in turn passes through the shell via the internal passages 18. Further, a continuous line or tube 20 is shown as extended through the shell 12 between inlet 22 and outlet 24 for conveying a heat-out fluid isolated from but in heat transfer contact with the heat-in fluid. Inlet pipe 26 connects through pump 28 for pressurizing the heat-out fluid as a liquid before the tube 20 while outlet line 30 schematically leads to conventional expansion equipment (not shown) such as steam turbines for generating electrical power or otherwise using the high energy of the vaporous output.

As illustrated, the heat-in fluid would flow through the annular passage 18 and pass over the exterior of the tube 20 in a downward direction from inlet 14 to outlet 16. The heat-out vaporizing fluid would enter the tube 20 as a liquid from the bottom inlet 22, would be forced upwardly through the tube in counterflow heat contact with the heated surface in passage 18, and would be discharged as a superheated vapor from outlet line 30.

According to the particular invention, a tee connection 42 is provided in the outlet line 30 for directing part of the superheated vapor through a compressor 44 powered by a motor 46 for high pressure vapor discharge via line 48 into tube 50 located in the tube 20. Some details of a typical arrangement are illustrated schematically in FIG. 5, the tube 50 being of circular cross section to fit within tube 20 likewise typically of circular cross section to define annular clearance or flow path 52. Spiders 55 (only one being shown) axially spaced apart along the tubes 20 and 50 and each disposed between the tubes serve to center the tube 50 within the tube 20 while yet allowing fluid flow axially of the annular flow path 52.

Figure 1:
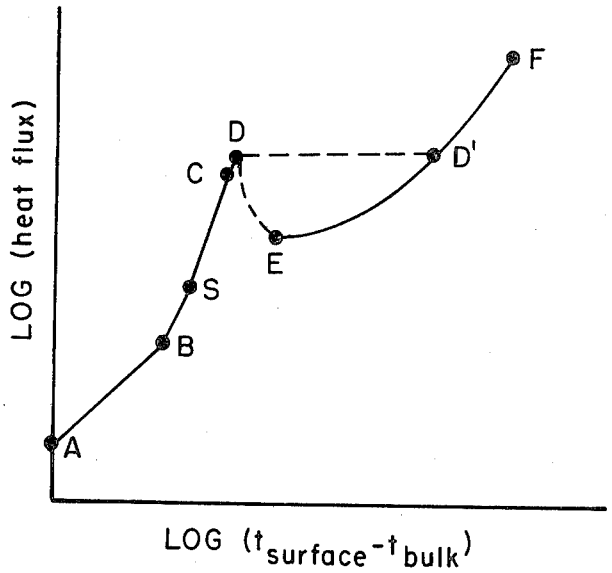
FIG. 1 is a typical pool-boiling curve illustrating the "heat flux" and "temperature differences" parameters of a multiphase fluid exposed in heat transfer contact with a surface heated to above the vaporization temperature of such fluid.

The invention might best be understood and appreciated by considering one specific application of the evaporator 10, having the heat-in fluid of sodium, for example with temperatures of 900° F. at the inlet 600° F. at the outlet, and the heat-out fluid of water confined under a pressure of 2250 psi, being a liquid at 450° F. at the inlet and being a vapor at 750° F. at the outlet under balance flow conditions. Nonetheless there exists a temperature difference potential for driving heat flux of between 150° F. and 350° F. between the heat-in and heat-out fluids across the walls of the tube 20; and moreover, the heat flux is quite high because sodium has a high thermal coefficient of heat transfer of the order of 2000–10,000. These factors are sufficient therefore normally to induce nucleate boiling of the water within the tube 20. Thus, as the liquid water passes through the tube it begins to vaporize, starting initially at 0% vapor and progressing to higher vapor conditions whereat DNB would normally occur. For these presumed factors, DNB would typically occur between 5–30% vapor, simulating the point D on the curve in FIG. 1. By design criterion this occurs also approximately 10–25% of the axial distance through the heat exchanger 10. It is just prior to this general location (where DNB would normally occur) that the subject invention is to be utilized.

The tube 50 has outlet nozzles 54 generally at this area which are intended to discharge high pressure superheated vapor into the multiphase mixture already flowing upwardly in the tube 20. Such steam is admitted in sufficient quantity operable to convert the multiphase mixture almost instantaneously to a significantly higher vapor condition (by a factor of perhaps 5–30%) so that thereafter the higher quality multiphase mixture continues through the annulus 52. This vapor addition takes place over a short axial distance along the tube 20, in the region just prior to DNB and quickly converts the heating of the multiphase mixture from nucleate boiling to film boiling or forced convection combined with nucleate boiling without any unstable DNB. Thus downstream of the discharge nozzles 54, the multiphase mixture is thereafter heated by a combination of stable heat transport mechanisms.

Note that with the tube 50 in tube 20 arrangement, the pure liquid or the low quality vapor multiphase mixture flows within the entire cross section of tube 20, while the higher quality vapor multiphase mixture flows in the annulus 52 of reduced cross section. Consequently, the reduced area flow path 52 forces higher velocities of the fluid to improve the effective heat transfer, and thus the efficiencies of the evaporator section itself. This is of importance since the liquid and low quality vapor normally has coefficients of heat transfer in the range of 2000–3000 while the higher quality vapor normally has coefficient of heat transfer in the range of 500–1000; but the later coefficient is nonetheless greatly improved because of the increase flow velocities.

The subject invention requires in the range between 25 and 50% bypass and recirculation of the superheated vapor from the evaporator outlet 30 back into the fluid mixture, as contrasted against almost the 400% recirculation of liquid in the conventional complex system with the steam separator as illustrated in FIG. 2 or the 75% recirculation in the complete Loffler cycle (FIG. 3). However, even with this recirculation, the invention yet provides a simplified single high output evaporator unit having the benefits of both feedwater and nucleate heating efficiencies, and virtually no unstable DNB transitions. The invention greatly minimizes thermal cycling and its adverse accompanying strain and fatigue factors and thereby increases the durability and life of the evaporator.

Figure 5:
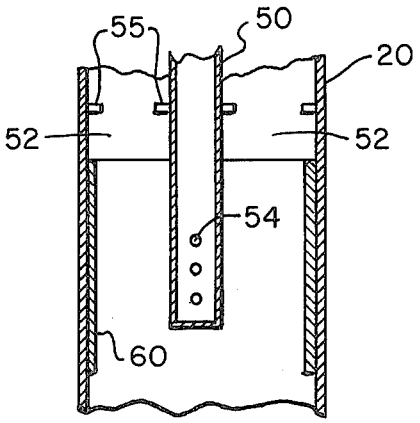
FIG. 5 is an enlarged sectional view of the injection means illustrated in FIG. 4 and showing how the same may more effectively be formed.

In this particular regard, FIG. 5 disclosed an alternate embodiment of the invention where, in the area proximate the steam ejection tube nozzles, a thermal liner 60 is provided in the tube 20. The liner 60 is located opposite the vapor discharge nozzles 54 effective to insulate the wall of tube 20 from the local temperatures of the composite multiphase mixture, which minimizes even more any thermal cycling of the tube wall itself. This economical construction of such a tube 20 and liner 60 would provide sustained operational life.

It can be seen from the foregoing, that the present invention provides an improved means for and method for minimizing unstable departure from nucleate boiling, and thereby provides a more effective arrangement of generating superheated vapor.

The embodiments of the invention in which an exclusive property or privilege is claimed are defined as follows:

1. In a multiphase vapor generator having a boiler surface, means for moving a fluid to be vaporized in heat transfer contact with the boiler surface progressively along a flow path between spaced inlet and outlet means, and means for heating the boiler surface to temperatures higher than the vaporization temperature of the fluid, whereby the fluid initially is in the liquid phase at the inlet means and ultimately is in the superheated vapor phase at the outlet means and is in a multiphase mixture phase therebetween increasing from 0% to 100% vapor in moving downstream along the flow path, the improved combination comprising injection means located proximate the boiler surface and in the flow path of the fluid at a location relative to the vapor percent of the multiphase mixture just upstream from where departure from nucleate boiling of the fluid at the boiler surface normally would occur, and means for discharging some of the same fluid as superheated vapor from the injection means in sufficient quantities to increase the vapor percent of the multiphase mixture of the fluid in the flow path and upstream of the injection means by between 5% and 30% vapor almost instantaneously, operable thereby to convert directly from nucleate boiling heating to stable combined convective and film boiling heating without any unstable departure from nucleate boiling.

2. A multiphase vapor generator combination according to claim 1 wherein, said boiler surface is on the inside of a tube and the fluid flows axially within the tube, and wherein said injection means is located within the tube and discharges the superheated vapor into the tube.

3. A multiphase vapor generator combination according to claim 2, wherein said injection means is provided as a part of a second tube axially fitted within the boiler surface tube.

4. A multiphase vapor generator combination according to claim 3, wherein said second tube also extends exteriorly of the boiler surface tube, and means including a compressor for directing the superheated vapor into the second tube at a location exteriorly of the boiler surface tube.

5. A multiphase vapor generator combination according to claim 4, wherein said injection means are in the form of nozzle openings in the second tube adapted to discharge the superheated vapor into the boiler surface tube.

6. A multiphase vapor generator combination according to claim 5, wherein the nozzle openings are located near the upsteam end of the boiler surface tube relative to the direction of the fluid flow through the boiler surface tube.

7. A multiphase vapor generator combination according to claim 6, wherein in the range of 25–50% of the fluid flow along the flow path over the boiler surface and downstream of the injection means is comprised of the fluid discharged from the injection means.

8. A multiphase vapor generator combination according to claim 6, further including a thermal liner in the boiler surface tube disposed between the boiler surface itself and the injection means effective to prevent direct discharging of the superheated vapor onto the boiler surface.

9. A multiphase vapor generator combination according to claim 1, wherein in the range of 25–50% of the fluid flow along the flow path over the boiler surface and downstream of the injection means is comprised of the fluid discharged from the injection means.

10. A multiphase vapor generator combination according to claim 9, wherein said boiler surface is on the inside of a tube and the fluid flows axially within the tube, and wherein said injection means is located within the tube and discharges the superheated vapor into the tube.

11. A multiphase vapor generator combination according to claim 10, further including a thermal liner in the boiler surface tube disposed between the boiler surface itself and the injection means effective to prevent direct discharging of the superheated vapor onto the boiler surface.

12. A multiphase vapor generator combination according to claim 10, wherein said injection means is provided as part of a second tube axially fitted within the boiler surface tube.

13. A multiphase vapor generator combination according to claim 12, wherein said second tube also extends exteriorly of the boiler surface tube, and means including a compressor for directing the superheated vapor into the second tube at a location exteriorly of the boiler surface tube.

14. A multiphase vapor generator combination according to claim 13, wherein said injection means are in the form of nozzle openings in the second tube adapted to discharge the superheated vapor into the boiler surface tube.

15. For use in a multiphase vapor generator having a boiler surface heated to temperatures higher than the vaporization temperature of a fluid to be vaporized, and means for moving the fluid along a flow path over the boiler surface whereupon the fluid starts in the liquid phase and progressively changes from the liquid phase through a multiphase mixture ranging from 0% to 100% vapor and finally ends in the superheated vapor phase, a method for converting from stable nucleate boiling heating to stable combined convective and film boiling heating without any unstable departure from nucleate boiling of the fluid as it moves along the boiler surface, comprising the step of injecting some of the same fluid as superheated vapor into the fluid moving along the flow path at a location proximate the boiler surface and in the region of the multiphase mixture near but upstream of where departure from nucleate boiling normally would occur, and in sufficient quantities to increase the multiphase mixture of the moving fluid by between 5% and 30% vapor almost instantaneously.

* * * * *